US010030392B2

(12) United States Patent
Lane

(10) Patent No.: US 10,030,392 B2
(45) Date of Patent: Jul. 24, 2018

(54) SUBFRAME SUPPORT FOR RETROFIT ROOF

(71) Applicant: Tim Alan Lane, Ravenna, OH (US)

(72) Inventor: Tim Alan Lane, Ravenna, OH (US)

( * ) Notice: Subject to any disclaimer, the term of this patent is extended or adjusted under 35 U.S.C. 154(b) by 0 days.

(21) Appl. No.: 15/786,095

(22) Filed: Oct. 17, 2017

(65) Prior Publication Data

US 2018/0112411 A1 Apr. 26, 2018

Related U.S. Application Data

(60) Provisional application No. 62/412,924, filed on Oct. 26, 2016.

(51) Int. Cl.
*E04D 13/16* (2006.01)
*E04D 3/36* (2006.01)

(52) U.S. Cl.
CPC ..... *E04D 13/165* (2013.01); *E04D 3/3607* (2013.01); *E04D 3/3608* (2013.01); *E04D 13/1643* (2013.01); *E04D 13/1656* (2013.01)

(58) Field of Classification Search
CPC ... E04D 13/165; E04D 3/3608; E04D 3/3607; E04D 13/1643; E04D 13/1656
See application file for complete search history.

(56) References Cited

U.S. PATENT DOCUMENTS 3,574,103 A 4/1971 Latkin
3,759,006 A 9/1973 Tamboise
4,034,135 A 7/1977 Passmore
4,494,343 A 1/1985 Berry et al.
4,894,967 A 1/1990 Morton
4,914,886 A 4/1990 Eriksson et al.
5,142,838 A 9/1992 Simpson et al.
5,187,911 A 2/1993 Cotter
5,367,848 A * 11/1994 McConnohie ..... E04D 3/3608 52/334
5,402,572 A 4/1995 Schulte et al.
5,557,903 A 9/1996 Haddock
5,600,971 A 2/1997 Suk
(Continued)

FOREIGN PATENT DOCUMENTS

GB 1200771 A 1/1983

OTHER PUBLICATIONS

Retreived from Internet www.cirrusconstruction.com/PDF/HighMOM5208Rev05.pdf on Sep. 23, 2013, Butler Manufacturing, High Profile Metal Over Metal Reroof System.
(Continued)

*Primary Examiner* — Andrew J Triggs
(74) *Attorney, Agent, or Firm* — Zollinger & Burleson Ltd.

(57) ABSTRACT

A subframe configuration for a retrofit roof includes a subframe connected to the upper surface of a rib on an existing roof. The subframe is also connected to the valley/purlin of the existing roof. The connection can be a mechanical interference connection or one that is formed by a mechanical connector. The subframe of the disclosure includes a rib flange that extends from the bottom of the lip. The rib flange is disposed substantially parallel to the base of the subframe. When installed, a connector extends through the rib flange into a rib of the existing roof. Rib flange can be continuous or provided only at each or just some of the ribs.

20 Claims, 6 Drawing Sheets

(56) References Cited

U.S. PATENT DOCUMENTS

| | | | | |
|---|---|---|---|---|
| 5,737,892 | A | 4/1998 | Greenberg | |
| 5,743,063 | A | 4/1998 | Boozer | |
| 5,765,329 | A | 6/1998 | Huang | |
| 5,911,663 | A | 6/1999 | Eidson | |
| 6,141,932 | A | 11/2000 | Tarrant | |
| 6,176,065 | B1 | 1/2001 | Honda | |
| 6,415,581 | B1 | 7/2002 | Shipman et al. | |
| 6,470,644 | B2 | 10/2002 | James et al. | |
| 6,655,099 | B1 | 12/2003 | Trenoweth | |
| 7,174,686 | B1 * | 2/2007 | Legband | E04D 3/3608 52/462 |
| 7,779,590 | B2 | 8/2010 | Hsu et al. | |
| 7,861,480 | B2 * | 1/2011 | Wendelburg | E04C 3/07 52/471 |
| 7,987,647 | B2 | 8/2011 | Rymell et al. | |
| 8,024,906 | B1 | 9/2011 | Nelson et al. | |
| 8,061,087 | B2 | 11/2011 | Ray | |
| 8,371,083 | B2 | 2/2013 | Chamberlin et al. | |
| 9,027,286 | B2 | 5/2015 | Lane | |
| 2001/0018816 | A1 | 9/2001 | Hoepker et al. | |
| 2008/0163573 | A1 * | 7/2008 | Wendelburg | E04C 3/07 52/262 |
| 2009/0094926 | A1 * | 4/2009 | Richmond | E04D 3/3608 52/550 |
| 2010/0275525 | A1 | 11/2010 | Wendelburg et al. | |
| 2012/0279165 | A1 | 11/2012 | Marshall | |
| 2018/0112411 | A1 * | 4/2018 | Lane | E04D 13/1643 |

OTHER PUBLICATIONS

Retreived from Internet www.archmetalroof.com/metal-over-metal-retrofit.html on Sep. 20, 2013 ABC-McElroy Metal, Metal Over Metal Retrofit.

Corru-Fit Design Guide, Roof Hugger, Retrofit Solutions for Existing Corrugated Metal Roofs, Copyright 2012.

TopHat Quik-Clip Retrofit Solution for Corrugated & Low Profile Panels, Copyright 2013.

Roof Hugger Completes testing of Corru-Fit Retrofit Product, printed Oct. 29, 2012.

* cited by examiner

SUBFRAME SUPPORT FOR RETROFIT ROOF

CROSS REFERENCE TO RELATED APPLICATIONS

This application claims the benefit of U.S. Provisional Patent Application Ser. No. 62/412,924 filed Oct. 26, 2016; the disclosures of which are incorporated herein by reference.

BACKGROUND OF THE DISCLOSURE

1. Technical Field

The present disclosure relates to retrofit roofing systems that are installed over existing metal roofs. More particularly, the present disclosure relates to the structure and installation of the support frame that supports the retrofit roof above the existing roof.

2. Description of Related Art

Metal roof decking is a building envelope system made from metal decking panels or sections. Each metal decking panel is secured by fasteners to the support structure (typically made of steel) of the building on which the roof is located. Metal roof decking is inherently strong and lightweight, and thus offers several advantages over other types of roofing (i.e., asphalt shingles, etc.), such as increased durability, energy efficiency, resistance to weather damage, and ease of installation, as well as being comparatively economical and having low maintenance requirements. Also, metal roof decking may be designed for use with pitched, flat, or arched construction, and may be applied to nearly all types of buildings.

Standing seam metal roofs are also popular on virtually all types of buildings due to their weather-tightness, durability, and flexible design. Additionally, standing seam metal roofs are more energy efficient and cost effective than many non-metal counterparts, and have an additional desired characteristic of allowing for thermal movement within the roof system.

Metal roof decking products have a number of shapes, materials, and aesthetic variations that can be used in constructing roof decking for buildings. One common type of metal roof decking is known as a fluted, or ribbed, roof decking. Ribbed metal roof decking includes a plurality of ribbed metal roof decking panels, each panel characterized by a sequence of alternating upper and lower surfaces that extend the length of the panel. The upper surfaces, or ribs, are found substantially in an upper plane, and are substantially parallel to each other. Likewise, the lower surfaces, or valleys, are found substantially in a lower plane, one that is generally parallel to and spaced vertically apart from the upper plane. The upper and lower surfaces are connected by a series of vertical or sloped walls which also extend the length of the panel. The upper, lower and vertical or sloped walls define flutes, or channels. When installed to form metal roof decking, the ribbed metal roof decking panels typically overlap one another, and span over and are secured by fasteners to underlying support structures, sometimes referred to as purlins. In this configuration, the ribbed metal roof decking panels are connected to form a continuous span to create the roof envelope of a building.

For various reasons, the metal roof decking of a building, in part or whole, may be in need of repair, replacement, upgrade, or a general retrofit. Due to the lightweight qualities of some metal roof decking, an existing roof may be retrofit by installing a system of subframes over the original roof decking, and securing the new roof decking to the subframe system. The use of subframe systems in this manner provides additional support and points of attachment for the new metal roof decking panels. In some instances, however, conventional subframe systems cannot be used to transition from an older roof configuration in need of retrofit to a new metal roof decking that complies with new construction practices and roof uplift requirements. Additionally, conventional subframe systems may not provide the necessary strength over a long roof span, and may require inefficient production and time-consuming installation processes.

Two subframe configurations from U.S. Pat. No. 7,861,480 are identified generally by reference numeral 100 in PRIOR ART FIGS. 1-3. A first prior art embodiment of roof subframe 100 is depicted in FIGS. 1 and 2. In this first exemplary embodiment, subframe 100 is an elongate support member that may be manufactured from a variety of metals having a wide range of thicknesses, including but not limited to, 14 or 16 gauge steel. In end view or in cross-section, subframe 100 may be described as generally hat-shaped. The "hat shape" of subframe 100 refers to the shape of its cross-section, which, when inverted from its orientation shown in FIG. 1, appears like a hat with a brim. Subframe 100 includes a base portion 107 that is spaced apart from an upper section with opposing horizontal surfaces that comprises first longitudinal flange 102 and second longitudinal flange 104. First and second longitudinal flanges 102, 104 are generally coplanar and oriented in a generally horizontal plane that is parallel to the plane of base 107. A first wall 106 and a second wall 108 extend vertically downward from a first edge of first longitudinal flange 102 and a first edge of second longitudinal flange 104, respectively. Although first and second walls 106, 108 are normal to first and second longitudinal flanges 102, 104 in this exemplary embodiment, first and second walls 106, 108 may extend from first and second longitudinal flanges 102, 104 in other angular orientations. As shown in FIG. 1, some embodiments of subframe 100 include a first lip 103 and a second lip 105 extending vertically downward from a second edge of first longitudinal flange 102 and a second edge of second longitudinal flange 104, respectively.

First and second walls 106, 108 are coupled to and interconnected by base 107. As shown, base 107 is the lowermost portion of subframe 100 and extends horizontally between respective ends of first and second walls 106, 108. A channel is formed by first wall 106, base 107, and second wall 108. A void, or punch out 109, is created in subframe 100. Punch out 109 extends along a central axis "C" that is generally perpendicular to the longitudinal axis "L" of subframe 100. Punch out 109 passes through corresponding sections of first wall 106, second wall 108, and base 107. When subframe 100 is installed over an existing roof panel, punch out 109 is configured to matingly receive or fit over a rib 230 of the existing roof panel. In the embodiment shown in FIG. 1, punch out 109 has a generally trapezoidal shape when viewed in a direction perpendicular to the longitudinal axis. Punch out 109 may have other shapes, however. The trapezoidal shape is one selected to generally correspond to or match the shape of raised ribs 230 on many conventional metal roof panels. While subframe 100 is depicted as having a single punch out 109, subframe 100 typically will include a plurality of punch outs 109 positioned at intervals along the length of subframe 100, thereby allowing subframe 100 to mate with a number of raised ribs 230 of the existing roof panels so as to accommodate any existing roof panel rib pattern.

FIGS. 2 and 3 depict a single subframe 100 member installed over an existing roof system 200. In practice, multiple subframes 100 would be installed over an existing roof system 200 in order to support new roof panels. The existing roof system 200 includes a plurality of purlin supports 210 and overlapping metal roof deck sections 220. Each section 220 includes a plurality of ribs 230, with each rib 230 positioned between and extending from two adjacent valleys 240. Each purlin support 210 includes top flange 212, configured to receive fasteners 300 that couple subframe member 100 and section 220 to purlin 210.

To couple subframe 100 to the existing roof system 200, subframe 100 is positioned over a section 220 in alignment with a purlin support 210 such that longitudinal flanges 102, 104 extend generally perpendicular to the direction of ribs 230 of existing roof system 200. When aligned with purlin support 210, base 107 of subframe 100 rests on valley 240 of existing roof section 220 with punch out 109 positioned over a rib 230, Fasteners 300 are then inserted through base 107 and valley 240 and into purlin support 210 at intervals along the length of subframe 100 to couple subframe 100 to top flange 212 of purlin support 210. In some embodiments, the respective heights of subframe 100 and ribs 230 may be chosen such that first and second lips 103, 105 extend so as to rest in contact with an upper surface of ribs 230, as shown in FIG. 3. Although the FIG. 3 configuration disclosures lips 103 and 105 in contact with the upper surface of ribs 230, this connection does not resist lateral or torque forces such as those that can be created by snow loads.

Subframe 100 may be created by a roll formed manufacturing process. With this process, the length of subframe 100 can easily be controlled and tailored to the desired span of existing metal roof decking to be retrofit. Moreover, with roll formed manufacturing, any length of subframe 100 is obtainable, allowing subframe 100 to be used on any span of existing roof decking.

SUMMARY OF THE DISCLOSURE

The disclosure provides a subframe configuration for a retrofit roof wherein the subframe is connected to the upper surface of the rib and to the valley/purlin of the existing roof. The connection can be a mechanical interference connection or one that is formed by a mechanical connector.

The subframe of the disclosure includes a rib flange that extends from the bottom of the lip. The rib flange is disposed substantially parallel to the base of the subframe. When installed, a connector extends through the rib flange into a rib of the existing roof. Rib flange can be continuous or provided only at each or just some of the ribs.

In one configuration, the subframe includes a base that is secured to the purlin through the metal roof deck sections. The base can define openings for the connectors. A wall extends up from the base. The height of the wall is at least the height of the rib but is typically higher to provide space to receive insulation. These can be up to twenty-four inches tall. A longitudinal flange extends from the top of the wall and is substantially parallel to the base. A lip extends down from the outer edge of the flange with the rib flange extending from the bottom of the lip.

An advantage of the rib flange is that the height of the wall can be increased to provide room for insulation.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

BRIEF DESCRIPTION OF THE DRAWINGS

Similar numbers refer to similar parts throughout the specification.

DETAILED DESCRIPTION OF THE DISCLOSURE

Figure 1:
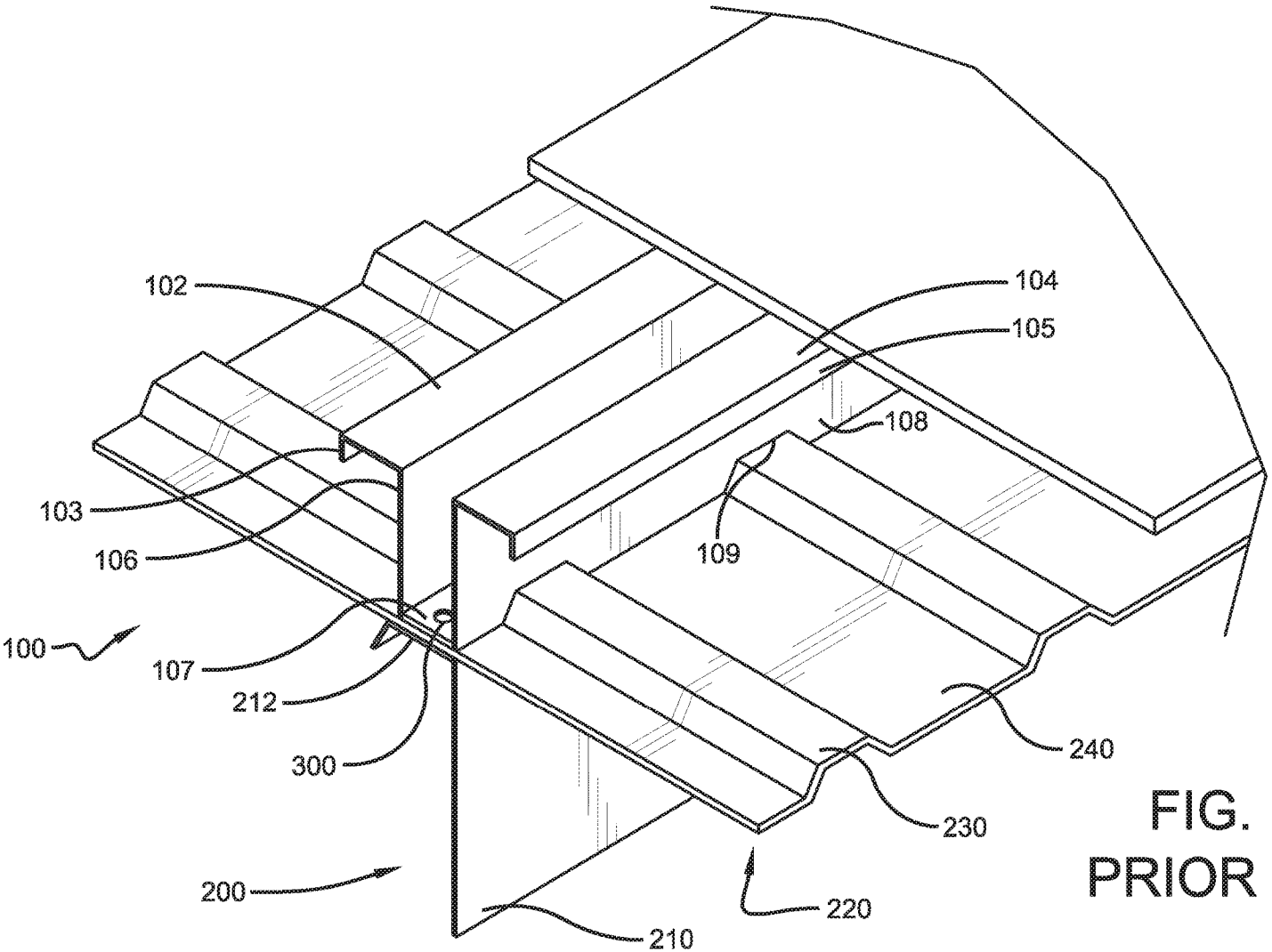
FIG. 1 PRIOR ART
FIG. 1 is a perspective view of the first configuration of the prior art subframe.
Figure 2:
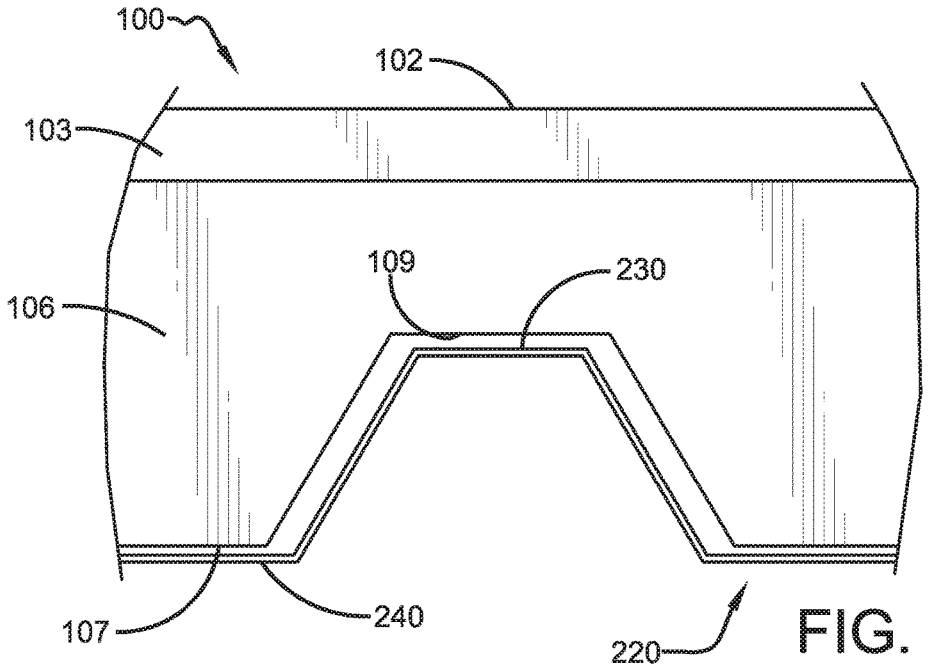
FIG. 2 PRIOR ART
FIG. 2 is a section view of the taken through a rib of FIG. 1.
Figure 3:
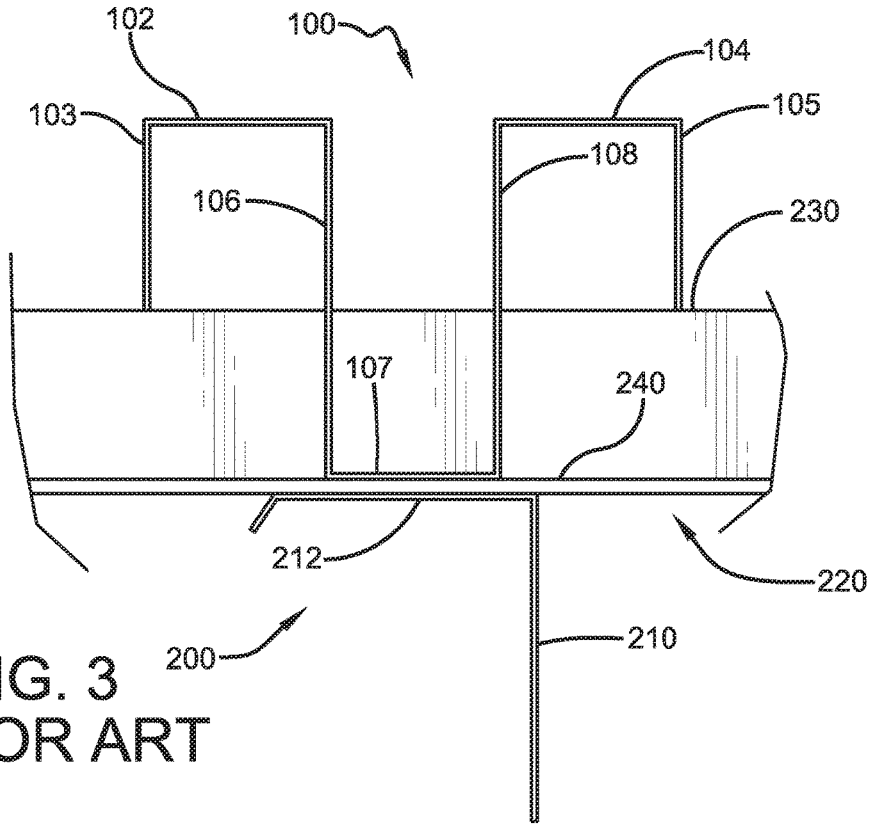
FIG. 3 PRIOR ART
FIG. 3 is an end view of the second configuration of the prior art subframe wherein the lips engage the rib.
Figure 4:
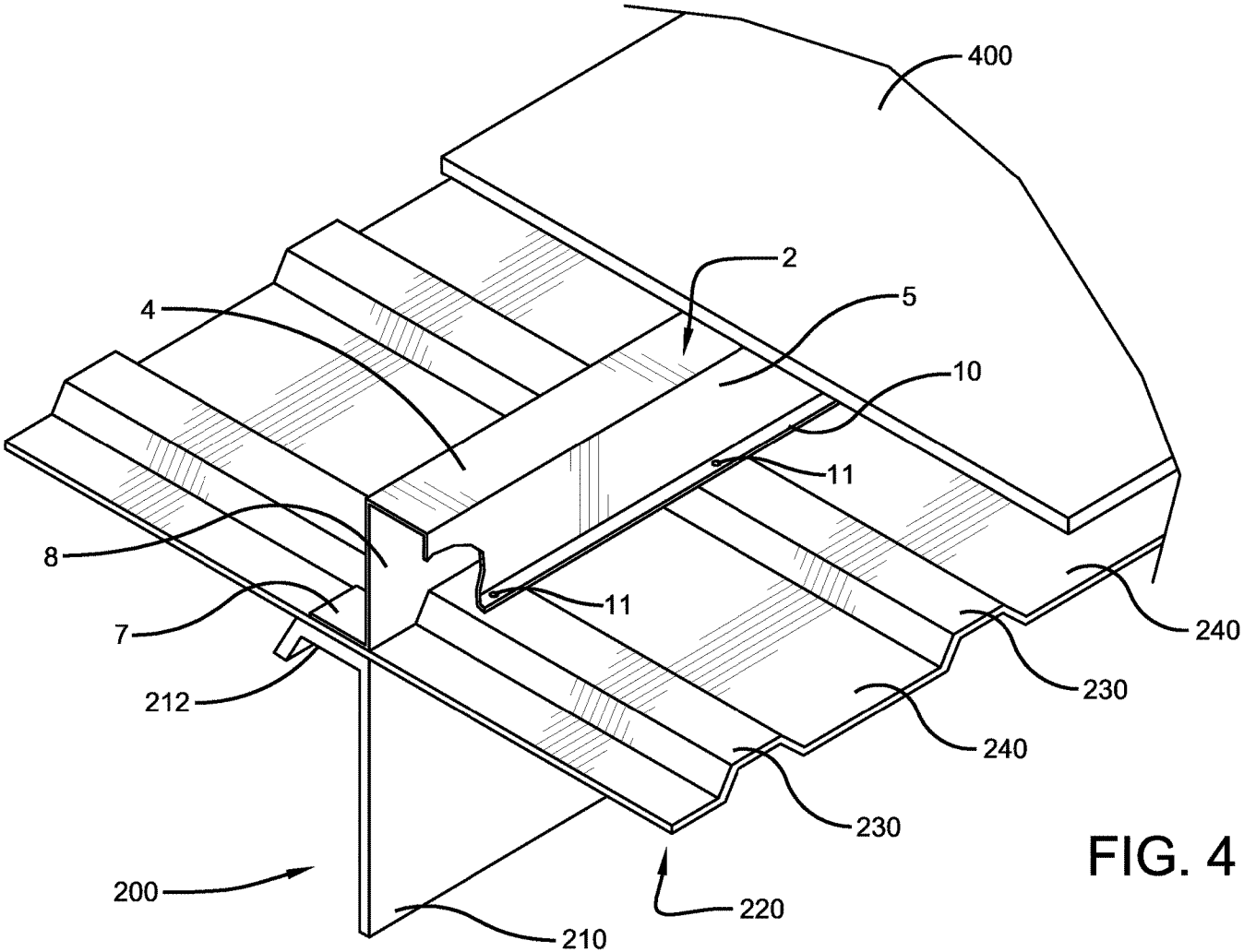
FIG. 4 is a perspective view of a first configuration of the subframe of the disclosure.

The exemplary subframes of the disclosure are indicated generally by the reference number 2 in FIGS. 4-7. The different embodiments of subframes 2 are shown disposed over an existing roof 220 that includes a plurality of ribs 230. Each subframe 2 defines a punch out passing through its base and its first wall wherein the punch out receives the rib 230 of the existing roof 220. Subframe 2 can be made from the same materials and by the same manufacturing techniques as described above.

Subframe 2 includes base 7 that is secured to purlin flange 212 through roof 220 with a fastener such as a screw or bolt. Wall 8 extends up substantially vertically from base 7 and can extend up from an edge of base 7. Wall 8 can also extend at a non-vertical angle. In either configuration, wall 8 taller than rib 230. Wall 8 also may extend substantially above the top of rib 230 to provide space for insulation. For example, wall 8 can be six, nine, twelve, fifteen, twenty or twenty four inches tall with rib 230 being one to three inches.

A top flange 4 extends from the top of wall 8. In the exemplary configuration, top flange 4 extends in a direction opposite to base 7 to define an "S" shape in cross section. In another configuration, flange 4 can extend in the same direction as base 7 to define a "C" shape in cross section.

Lip 5 extends down from the outer edge of flange 4 to engage the top of rib 230. Lip 5 can be vertical or disposed at a non-vertical angle.

Figure 5:
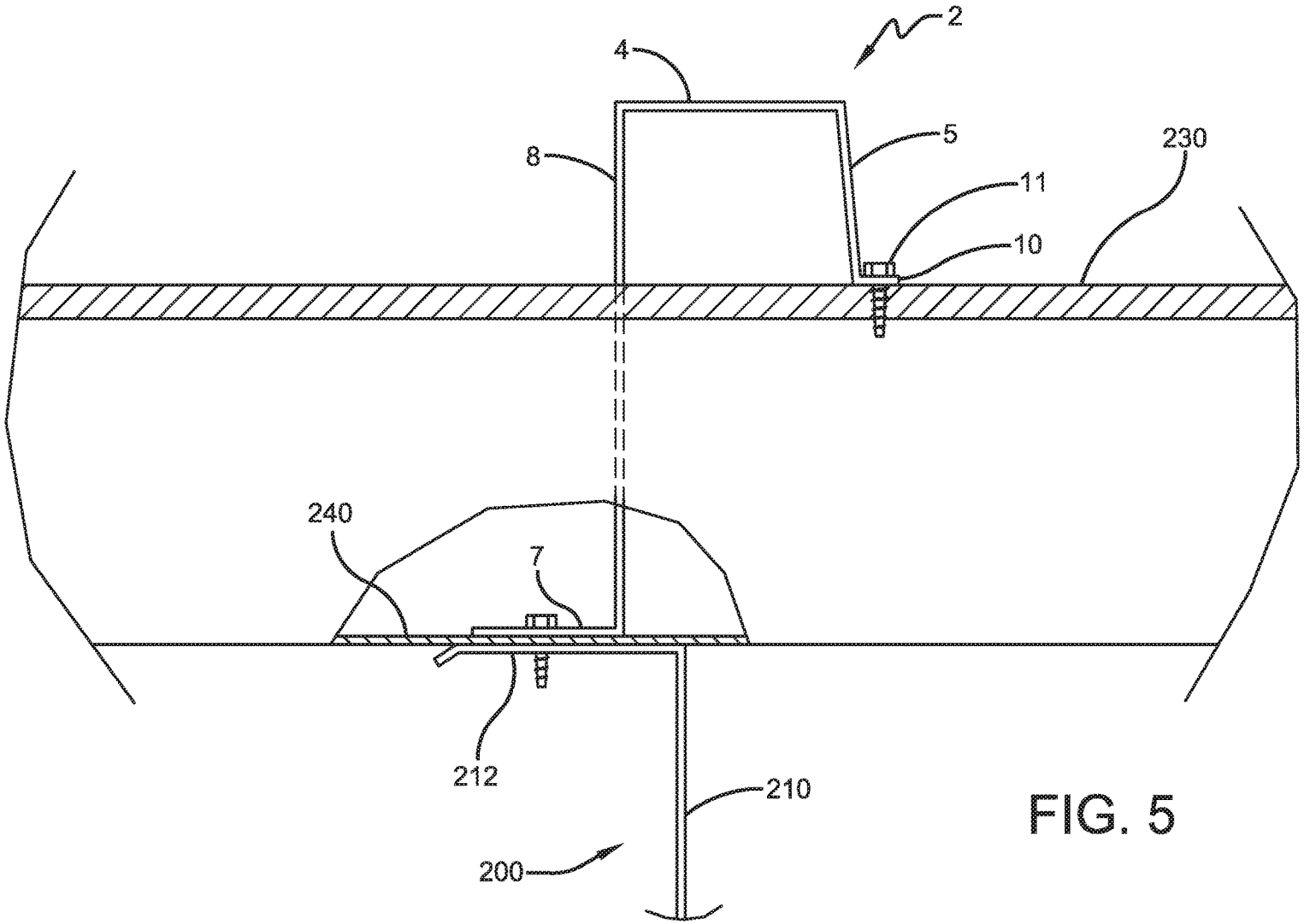
FIG. 5 is section view of the subframe of FIG. 4.
Figure 6:
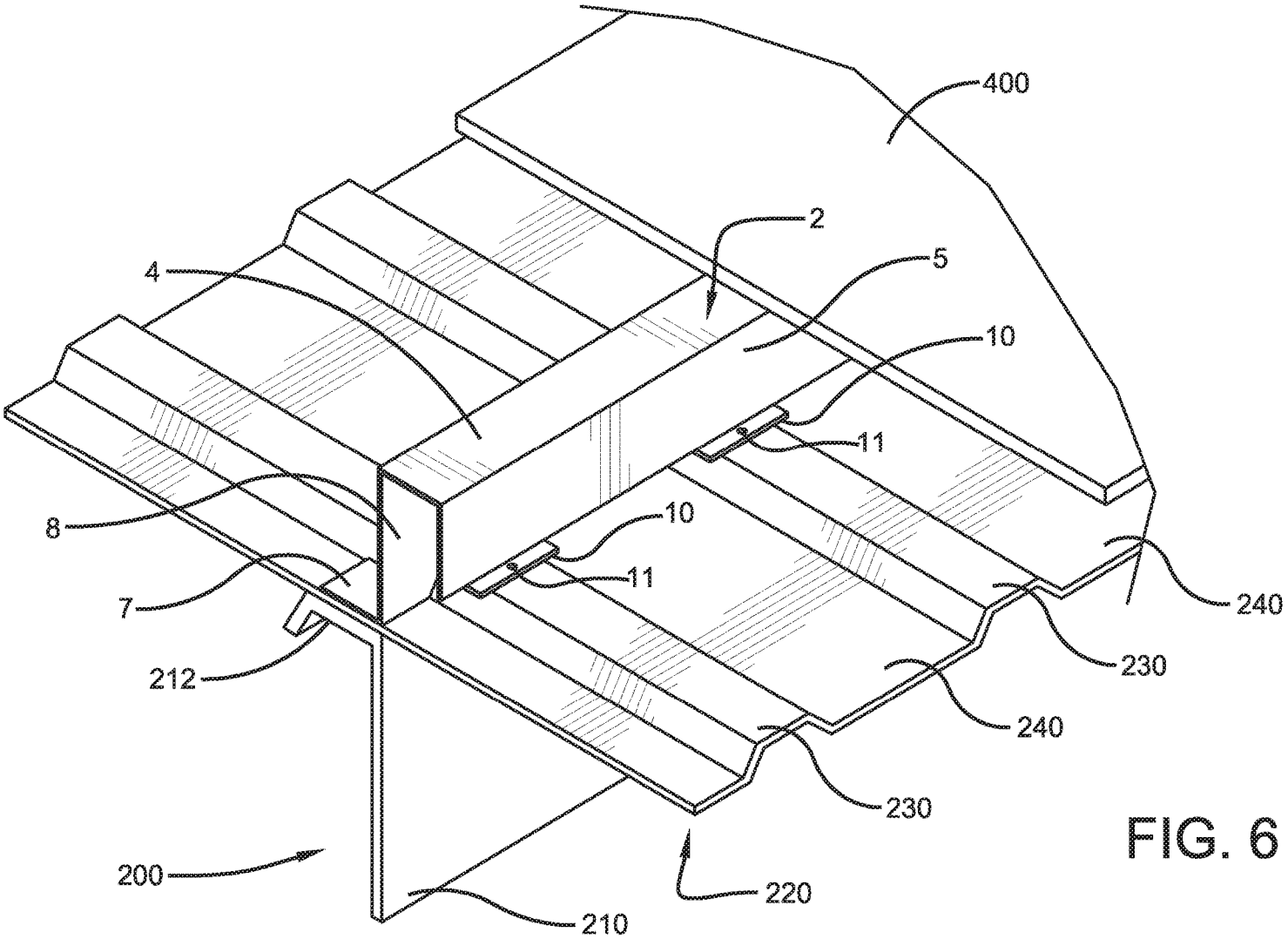
FIG. 6 is a perspective view of a second configuration of the subframe of the disclosure.
Figure 7:
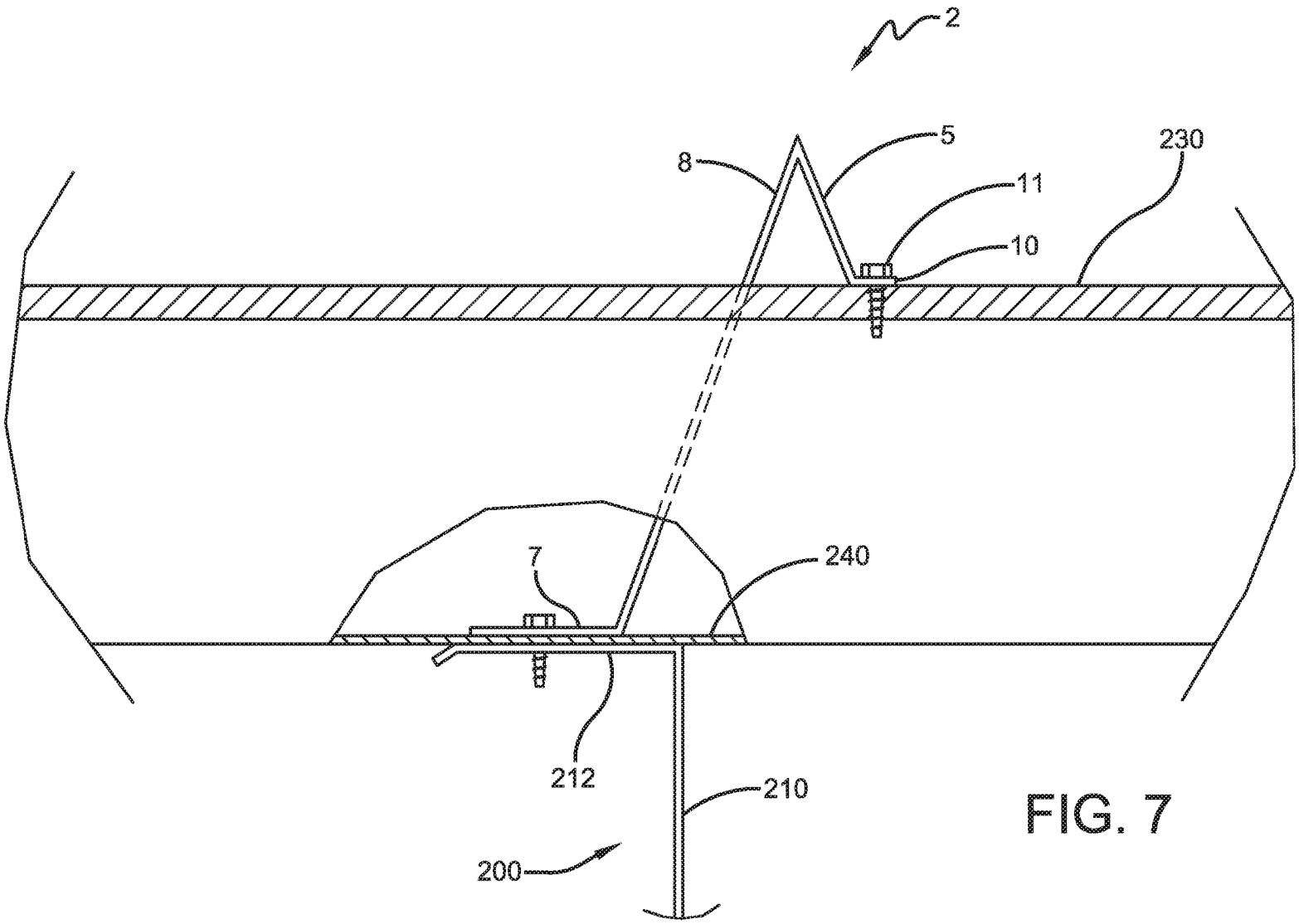
FIG. 7 is a section view similar to FIG. 4 showing an alternative configuration of the subframe of the disclosure.

In the configuration of subframe 2 depicted in FIG. 7, flange 4 is removed and lip 5 extends down from the top of wall 8. Either lip 5 or wall 8 or both can be non-vertical. The combination of base 7, wall 8, and lip 5 provide a self-supporting structure. The configurations of FIGS. 5 and 7 can be used in combination A rib flange 10 extends outwardly from the lower edge of lip 5. Rib flange 10 is substantially parallel to base 7. Rib flange 10 can be continuous as shown in FIG. 5 or providing in spaced sections that are disposed only above ribs 230 as shown in FIG. 6. Rib flange 10 is connected to rib 230 with a mechanical connector such as a metal screw 11 or a rivet 11 or an interference fit such as a tab that extends from rib flange 10 into an opening defined by or formed in rib 230.

Subframe 2 is thus connected to the existing roof with a pair of spaced connections which allows subframe 2 to resist lateral forces and torque forces. A retrofit roof 400 is connected to the subframes 2

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the descriptions and illustrations of the exemplary configurations are examples and the claimed invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A roof system comprising:

a first roof panel supported by a support member; the first roof panel having at least one raised rib projecting above a valley; the at least one raised rib having an upper surface;

a second roof panel; and a subframe positioned between the first roof panel and the second roof panel, the subframe including: a base; a first wall extending between the base and a top flange; a lip spaced apart from the first wall and extending down from the top flange; a rib flange extending from the lip and being connected to the raised rib above the valley; and the subframe defining a punch out passing through the base and the first wall wherein the punch out receives the raised rib of the first roof panel.

2. The roof system of claim 1, wherein the base, the first wall, and the lip form a self-supporting structure.

3. The roof system of claim 1, wherein the subframe is disposed on said first roof panel such that the raised rib extends in a direction generally perpendicular to the subframe.

4. The roof system of claim 1, wherein the subframe is connected to the support member through the first roof panel.

5. The roof system of claim 1, wherein the second roof panel is connected to the top flange of the subframe.

6. The roof system of claim 1, wherein the base, top flange, and rib flange are parallel.

7. The roof system of claim 1, wherein the lip includes an upper end and a lower end; the rib flange projecting from the lower end of the lip.

8. The roof system of claim 7, wherein the top flange is connected to the upper end of the lip.

9. The roof system of claim 1, further comprising insulation disposed between the first and second roof panels.

10. The roof system of claim 1, wherein the rib flange is connected to the upper surface of the at least one raised rib with a mechanical connector.

11. A roof system comprising:

a first roof panel supported by a support member; the first roof panel having at least one raised rib projecting above a valley; the at least one raised rib having an upper surface;

a second roof panel; and a subframe positioned between the first roof panel and the second roof panel, the subframe including: a base; a first wall extending between the base and a top flange; a lip spaced apart from the first wall and extending down from the top flange; a plurality of spaced rib flanges extending from the lip with each rib flange being connected to the raised rib above the valley; and the subframe defining a punch out passing through the base and the first wall wherein the punch out receives the raised rib of the first roof panel.

12. The roof system of claim 11, wherein the base, the first wall, and the lip form a self-supporting structure.

13. The roof system of claim 11, wherein the subframe is disposed on said first roof panel such that the raised rib extend in a direction generally perpendicular to the subframe.

14. The roof system of claim 11, wherein the subframe is connected to the support member through the first roof panel.

15. The roof system of claim 11, wherein the second roof panel is connected to the top flange of the subframe.

16. The roof system of claim 11, wherein the base, top flange, and rib flanges are parallel.

17. The roof system of claim 11, wherein the lip includes an upper end and a lower end; the rib flanges projecting from the lower end of the lip.

18. The roof system of claim 17, wherein the top flange is connected to the upper end of the lip.

19. The roof system of claim 11, further comprising insulation disposed between the first and second roof panels.

20. The roof system of claim 11, wherein the rib flange is connected to the upper surface of the at least one raised rib with a mechanical connector.

* * * * *